US010871011B2

(12) United States Patent
Rosales

(10) Patent No.: US 10,871,011 B2
(45) Date of Patent: Dec. 22, 2020

(54) METHOD FOR OPERATING A MOTOR VEHICLE LOCK

(71) Applicant: Brose Schliesssysteme GmbH & Co. Kommanditgesellschaft, Wuppertal (DE)

(72) Inventor: David Rosales, Rochester Hills, MI (US)

(73) Assignee: Brose Schliesssysteme GmbH & Co. KG, Wuppertal (DE)

( * ) Notice: Subject to any disclaimer, the term of this patent is extended or adjusted under 35 U.S.C. 154(b) by 162 days.

(21) Appl. No.: 16/003,941

(22) Filed: Jun. 8, 2018

(65) Prior Publication Data

US 2019/0376323 A1 Dec. 12, 2019

(51) Int. Cl.

| | |
|---|---|
| ***E06B 3/00*** | (2006.01) |
| ***E05B 81/22*** | (2014.01) |
| ***E05B 81/58*** | (2014.01) |
| ***E05B 79/20*** | (2014.01) |
| *E05B 83/40* | (2014.01) |

(52) U.S. Cl.

CPC ..... *E05B 81/22* (2013.01); *E05B 79/20* (2013.01); *E05B 81/58* (2013.01); *E05B 83/40* (2013.01)

(58) Field of Classification Search

CPC ..... E05B 81/22; E05B 81/58; E05B 81/14; E05B 81/66; E05B 81/20; E05B 79/20

USPC ..... 49/506

See application file for complete search history.

(56) References Cited

U.S. PATENT DOCUMENTS

| | | | | |
|---|---|---|---|---|
| 10,017,978 | B2 * | 7/2018 | Thiele | E05F 15/632 |
| 10,378,252 | B2 * | 8/2019 | Ottino | E05B 85/243 |
| 2003/0046872 | A1 * | 3/2003 | Fukumura | E05F 15/632 49/360 |
| 2018/0328086 | A1 * | 11/2018 | Barmscheidt | E05B 77/26 |
| 2019/0277068 | A1 * | 9/2019 | Nelsen | E05B 81/16 |
| 2019/0301212 | A1 * | 10/2019 | Digel | E05B 81/36 |
| 2019/0376323 | A1 * | 12/2019 | Rosales | E05B 81/22 |
| 2020/0024874 | A1 * | 1/2020 | Rosales | E05B 81/21 |
| 2020/0024875 | A1 * | 1/2020 | Rosales | E05B 81/14 |
| 2020/0115932 | A1 * | 4/2020 | Ottino | E05B 81/01 |
| 2020/0131808 | A1 * | 4/2020 | Kim | E05B 81/06 |

FOREIGN PATENT DOCUMENTS

| | | |
|---|---|---|
| EP | 1617021 | 8/2007 |

* cited by examiner

*Primary Examiner* — Jerry E Redman

(74) *Attorney, Agent, or Firm* — Pauly, DeVries Smith & Deffner LLC

(57) ABSTRACT

A method for operating a motor vehicle lock by a lock control. A catch of the motor vehicle lock may be moved into an open position, into a preliminary latching position and into a main latching position, wherein the catch is or may be brought into holding engagement with a lock striker. A cinching element and a cinching drive are provided. During a cinching routine, the catch is being moved into its main latching position by the cinching drive via the cinching element. A manual movement of the catch into the preliminary latching position causes the cinching routine to be initiated by the lock control. During the cinching routine, the catch performs a first catch movement in its opening direction from the preliminary latching position into a safety position and a second catch movement in its closing direction from the safety position into the main latching position.

10 Claims, 4 Drawing Sheets

METHOD FOR OPERATING A MOTOR VEHICLE LOCK

FIELD OF THE TECHNOLOGY

The disclosure is directed to a method for operating a motor vehicle lock, to a motor vehicle lock arrangement and to a motor vehicle door arrangement.

BACKGROUND

The motor vehicle lock in question is assigned to a motor vehicle door arrangement, which comprises at least a motor vehicle door. The expression "motor vehicle door" is to be understood in a broad sense. It includes in particular side doors, back doors, liftgates, trunk lids or engine hoods. Such a motor vehicle door may generally be designed as a sliding door as well.

In order to increase the user-friendliness during closing of the motor vehicle door, today's motor vehicle locks are often equipped with a so-called cinching function. The cinching function provides a motorized movement of the catch of the motor vehicle lock from its preliminary latching position into its main latching position, which goes along with pulling the respective motor vehicle door from a preliminary door position into a main door position. This very last part of the closing movement of the motor vehicle door requires a considerable force against the door seals. This is why the cinching function is to be considered an important comfort feature.

The known method (EP 1 617 021 B1), which is the starting point for the disclosure, represents a possible realization of the above noted cinching function. According to this it is known that the motor vehicle lock is provided with a cinching element and a cinching drive, such that, during a cinching routine, the catch may be moved into its main latching position by the cinching drive via the cinching element. The cinching routine is initiated by a manual movement of the catch into the preliminary latching position. This manual movement of the catch into its preliminary latching position goes back on the user moving the motor vehicle door manually into the preliminary door position.

While normally the above noted cinching function increases the user-friendliness in a very intuitive way, the cinching function also comprises a certain injury risk. The reason for this is the fact that with the catch in its preliminary latching position, a certain gap between the motor vehicle door and the motor vehicle body remains. In case an object, finger or the like has been inserted into the gap, the full cinching force is applied to such means. This generally decreases the operational safety of the motor vehicle lock in question.

SUMMARY

It is therefore the object of some embodiment of the disclosure to improve the known method for operation a motor vehicle lock such that the operational safety of the cinching function is increased with low constructional effort.

The above noted object is solved for a method as described herein.

According to some embodiments of the disclosure, the movement of the catch in its closing direction into the main latching position is preceded by a movement of the catch in its opening direction. This seems awkward at first, as the movement of the catch in its opening direction is exactly the opposite from what is intended by the cinching function, namely to move the catch into its main latching position. However, this first movement of the catch in its opening direction, which might even be a very small movement, has considerable advantages in view of the operational safety of the motor vehicle lock altogether.

In detail it is proposed that during the cinching routine the catch performs a first catch movement in its opening direction from the preliminary latching position into a safety position and a second catch movement in its closing direction from the safety position into the main latching position.

At that point it may be clarified that the opening direction of the catch is the direction, in which the catch is moved while being transferred from the main latching position into the preliminary latching position. The closing direction of the catch is accordingly the opposite direction of movement.

The effect of the first catch movement in its opening direction is first of all, that the user, whose finger accidently has been inserted into the gap between the motor vehicle door and the motor vehicle body just before the cinching routine is starting, may easily be removed from the gap, as the gap during the first catch movement is at least slightly being widened.

Second of all, the start of the first catch movement notifies the user that the "real" cinching action, namely the second catch movement, is about to take place. Accordingly, the first catch movement is nothing else than a haptic notification to the user that it is advisable to remove his finger from the above noted gap.

In some embodiments the first catch movement is defined by both the opening drive of the pawl and the cinching drive of the cinching element. Basically, with the cinching element being positioned in its holding position, the extent of the first catch movement in the opening direction of the catch is predefined. The movement of the pawl into its release position releases the catch, such that the catch, driven by spring forces, forces of door seals or the like, can fall into its safety position, in which it is being held by the cinching element. In some embodiments, the cinching element holds the catch in its safety position by firmly staying in its holding position. For this, the drive train, that is assigned to the cinching drive, can be designed as a self locking drive train, as will be explained later.

As noted above, the first catch movement may be energized simply by a catch spring and/or the sealing pressure of door seals assigned to the motor vehicle door. This makes the realization of the first catch movement particularly easy.

It may be pointed out that the cinching drive as well as the opening drive may be provided with at least one electrical motor, in particular an electrical rotational motor. It may also be advantageous to use only one electrical motor for both the cinching drive and the opening drive. This may be realized by integrating a switchable coupling between the motor and the output of the respective drive.

The second catch movement can be realized by the catch being driven into its main latching position by the cinching drive via the cinching element. Once the catch has passed its preliminary latching position, this movement corresponds to the cinching movement of a catch known from the state of the art.

Various embodiments are directed to the size of the gap between the motor vehicle door and the motor vehicle body, which is going back on the catch being moved into its preliminary latching position respective into its safety position.

In various embodiments, the drive train, that is assigned to the cinching drive, is designed as a self-locking drive train. This means that it is not possible to back drive the cinching element by exerting a force onto the catch. This means that holding the catch in its safety position is possible simply by positioning the cinching element into its holding position and by subsequently turning off the cinching drive.

Another embodiment is directed to a motor vehicle lock arrangement as such. Here it is of particular importance that the lock control is designed such that during the cinching routine the catch performs a first catch movement in its opening direction from the preliminary latching position into a safety position and a second catch movement in its closing direction from the safety position into the main latching position. In some embodiments, according to this teaching, the first catch movement is initiated by the opening drive according to some embodiments and the second catch movement is performed by the cinching drive according to some embodiments. For further details with regard to the second teaching, reference is made to all explanations with regards to the first teaching.

According to various embodiments, a motor vehicle door arrangement with a motor vehicle door and a motor vehicle lock arrangement as noted above is disclosed. All explanations given with regard to the first two teachings may be applied to the third teaching in their entirety.

Various embodiments provide a method for operating a motor vehicle lock of a motor vehicle door arrangement by a lock control, wherein the motor vehicle lock comprises a catch and a pawl, which is assigned to the catch, wherein the catch may be moved into an open position, into a preliminary latching position and into a main latching position, wherein the catch, which is in one the latching positions, is or may be brought into holding engagement with a lock striker, wherein the pawl may be moved into an engagement position, in which it is in blocking engagement with the catch, and wherein the pawl may be moved into a release position, in which it releases the catch, wherein a cinching element and a cinching drive are provided and wherein, during a cinching routine, the catch is being moved into its main latching position by the cinching drive via the cinching element, wherein a manual movement of the catch into the preliminary latching position causes the cinching routine to be initiated by the lock control, characterized in that during the cinching routine the catch performs a first catch movement in its opening direction from the preliminary latching position into a safety position and a second catch movement in its closing direction from the safety position into the main latching position.

In various embodiments, during the cinching routine the cinching element is being driven into a holding position by the cinching drive and the pawl is being driven into its release position by an opening drive, such that the catch, as the first catch movement, falls into its safety position and is being held there by the cinching element.

In various embodiments, the first catch movement is being driven by a catch spring and/or the sealing pressure of door seals assigned to the motor vehicle door.

In various embodiments, after the first catch movement, as the second catch movement, the catch is being driven into its main latching position by the cinching drive via the cinching element.

In various embodiments, in the mounted state, with the catch being moved from the preliminary latching position into the safety position during the first catch movement, the gap between the motor vehicle door and the motor vehicle body increases from a preliminary gap to a safety gap.

In various embodiments, the safety gap is larger than the preliminary gap by 25% up to 100%.

In various embodiments, the size of the preliminary gap is between 4 mm and 8 mm, such as 6 mm.

In various embodiments, the size of the safety gap is between 6 mm and 12 mm, such as 9 mm.

In various embodiments, the drive train, that is assigned to the cinching drive, is designed as a self-locking drive train.

In various embodiments, the holding of the catch by the cinching element is being performed by the drive train without activating the cinching drive.

Various embodiments provide a method vehicle lock arrangement with a motor vehicle lock and a lock control, wherein the motor vehicle lock comprises a catch and a pawl, which is assigned to the catch, wherein the catch may be moved into an open position, into a preliminary latching position and into a main latching position, wherein the catch, which is in one the latching positions, is or may be brought into holding engagement with a lock striker, wherein the pawl may be moved into an engagement position, in which it is in blocking engagement with the catch, and wherein the pawl may be moved into a release position, in which it releases the catch, wherein a cinching element and a cinching drive are provided and wherein, during a cinching routine, the catch is being moved into its main latching position by the cinching drive via the cinching element, wherein a manual movement of the catch into the preliminary latching position causes the cinching routine to be initiated by the lock control, wherein the lock control is designed such that during the cinching routine the catch performs a first catch movement in its opening direction from the preliminary latching position into a safety position and a second catch movement in its closing direction from the safety position into the main latching position.

In various embodiments, the motor vehicle lock arrangement comprises an opening drive and that during the cinching routine the cinching element is being driven into a holding position by the cinching drive and the pawl is being driven into its release position by the opening drive, such that the catch, as the first catch movement, falls into its safety position and is being held there by the cinching element.

Various embodiments provide a motor vehicle door arrangement with a motor vehicle door and a motor vehicle lock arrangement as described herein.

BRIEF DESCRIPTION OF THE DRAWINGS

In the following disclosure, embodiments will be described in an example referring to the drawings. In the drawings.

DETAILED DESCRIPTION

Figure 1:
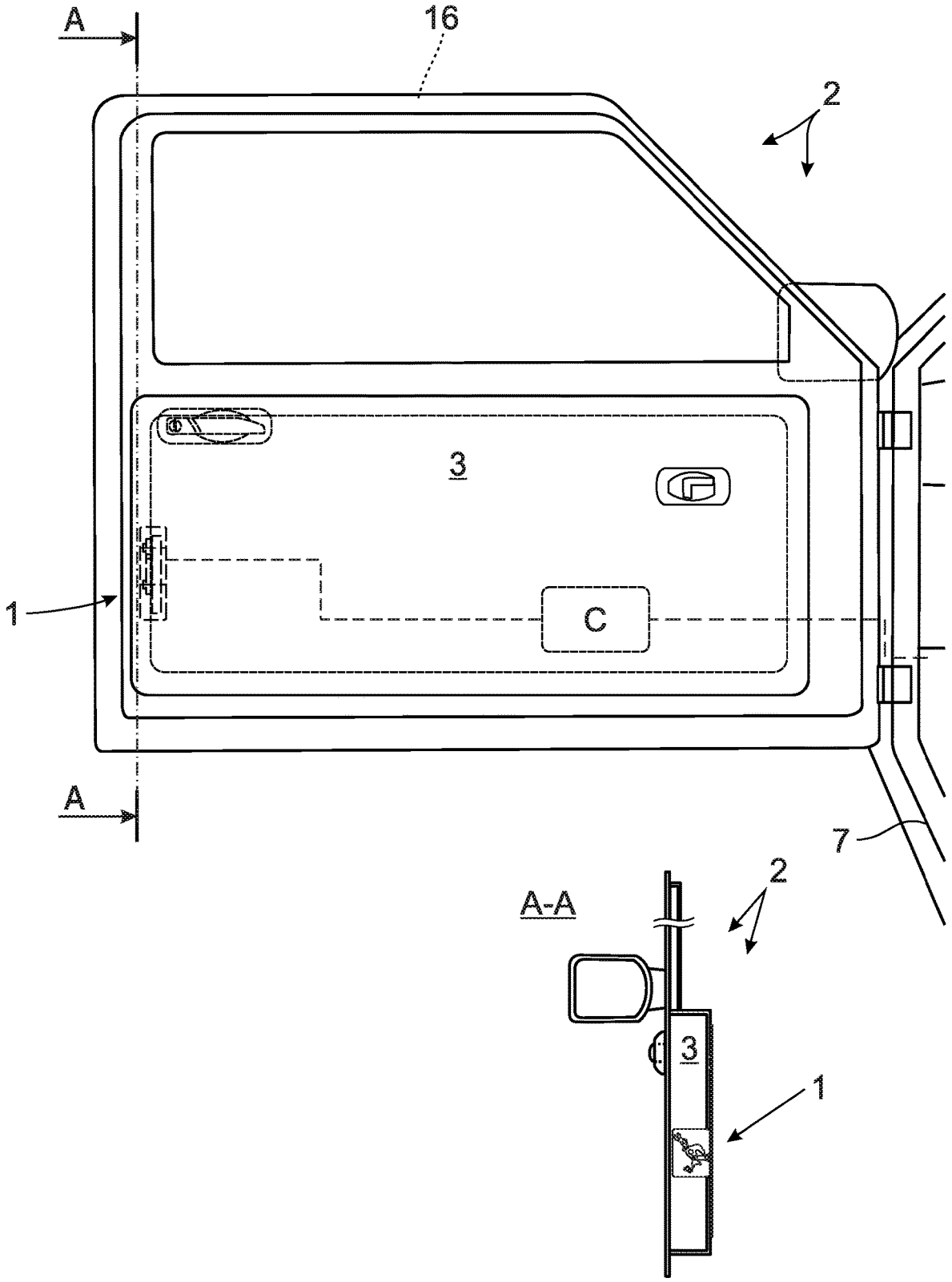
FIG. 1 shows a proposed motor vehicle door arrangement for performing the proposed method.

The motor vehicle lock 1 shown in the drawings is assigned to a motor vehicle door arrangement 2, which comprises a motor vehicle door 3 besides said motor vehicle lock 1. The motor vehicle lock 1 is designed to being operated according to the proposed method by a lock control C.

Regarding the broad interpretation of the expression "motor vehicle door", reference is made to the introductory part of the specification. Here, the motor vehicle door 3 is a side door of a motor vehicle.

The motor vehicle lock 1 comprises the usual locking elements catch 4 and pawl 5, which pawl 5 is assigned to the catch 4. The catch 4 may be moved into an open position (FIG. 2), into a preliminary latching position (FIG. 3*a, b*) and into main latching position (FIG. 4). The catch 4, which is in one of the latching positions, is or may be brought into holding engagement with a lock striker 6, as is shown in FIG. 4 for the example of the main latching position of the catch 4.

Here, the motor vehicle lock 1 is arranged on the motor vehicle door 3, while the lock striker 6 is arranged on the motor vehicle body 7. This may be realized the other way around as well.

Figure 2:
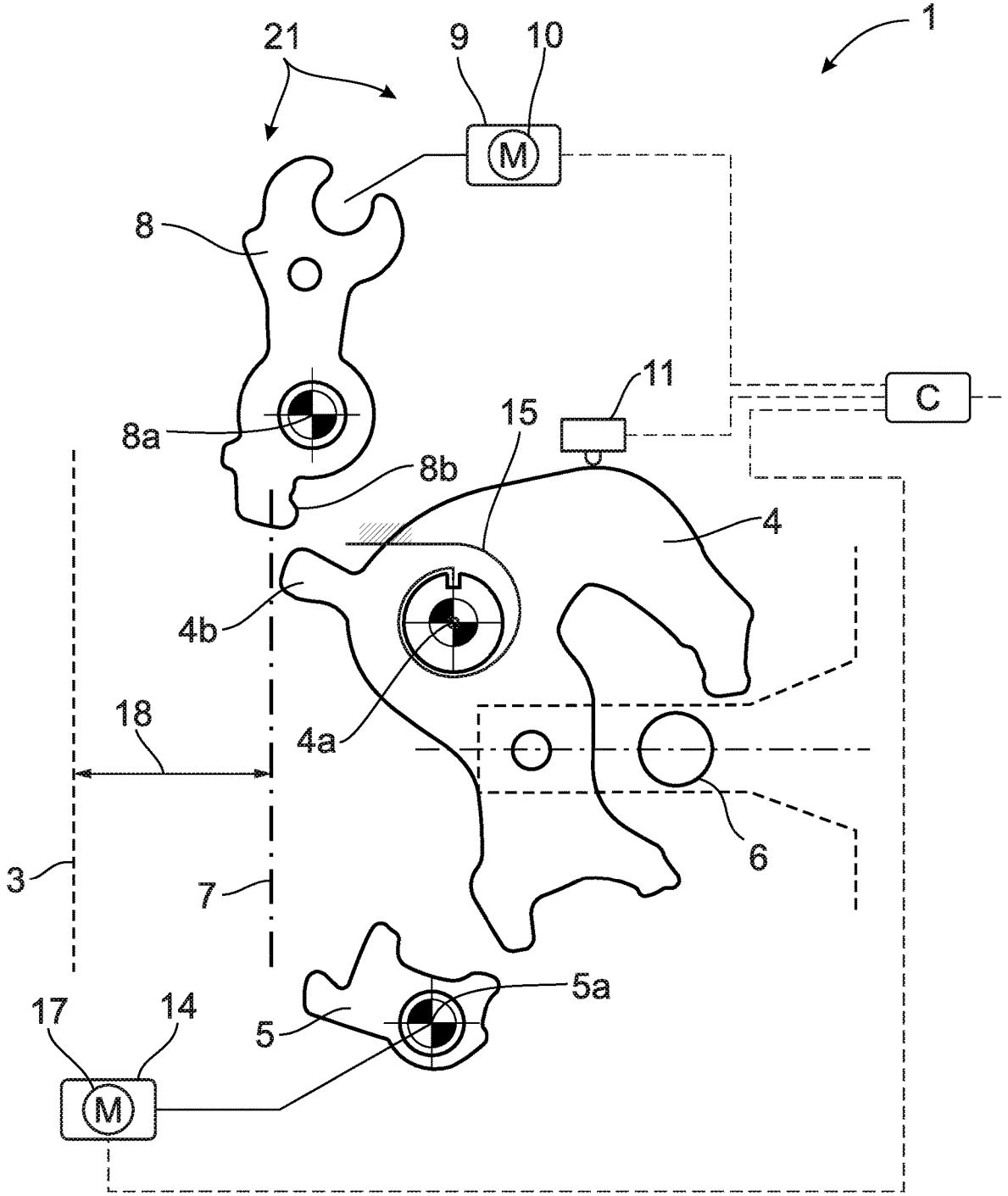
FIG. 2 shows the motor vehicle lock with the catch in its open position.

The pawl 5 may be moved into an engagement position, which is shown in FIG. 3*a, b* for the preliminary latching position and in FIG. 4 for the main latching position. In the engagement position, the pawl 5 is in blocking engagement with the catch 4, preventing the catch 4 from moving into its opening direction. In addition, the pawl 5 may be moved into a release position, which is shown in FIG. 2 and FIG. 3*c*). In the release position, the pawl 5 releases the catch 4, freeing the catch 4 to a movement in its opening direction.

Here the catch 4 is pivotable around the catch axis 4*a*, while the pawl 5 is pivotable around pawl axis 5*a*. Generally, there are other possibilities for realizing the movement of catch 4 and/or pawl 5.

For realizing the above noted cinching function, a moveable, in particular pivotable, cinching element 8 and a cinching drive 9 are provided. The cinching drive 9 may be integrated into the motor vehicle lock 1. As an alternative, the cinching drive 9 may be realized separately from the motor vehicle lock 1. In this alternative, the cinching drive 9 may be drivingly coupled to the motor vehicle lock 1, in particular to the cinching element 8, via a bowden cable arrangement or the like.

In any case, the cinching element 8 has to be drivingly coupled to the cinching drive 9, such that the cinching element 8 may be driven by the cinching drive 9 during a cinching routine.

Here the cinching drive 9 is designed as a motorized drive. Accordingly, the cinching drive 9 can comprise a cinching motor 10, which further can be realized as an electric motor. The electric motor further can comprise a rotational output shaft, which is drivingly coupled to the cinching element 8 as noted above.

During the cinching routine, the catch 4 is being moved into its main latching position by the cinching drive 9 via the cinching element 8. For this, the cinching element 8 engages the catch 4, as may be taken from the transition of FIG. 3*c*) to FIG. 4.

The cinching element 8, here, is designed as a cinching lever, which is pivotable around a cinching axis 8*a*. For the engagement with the catch 4, the cinching element 8 comprises an engagement section 8*b*, which may be brought into a counter engagement section 4*b* of the catch 4 in order to move the catch 4 into its main latching position shown in FIG. 4.

It may be pointed out, that the cinching element 8 is outside the path of movement of the catch 4, as long as the cinching routine is not being performed. In this situation, the cinching element 8 is in its parking position shown in FIG. 2 for example.

According to some embodiments of the disclosure, the cinching routine is initiated in a very intuitive way. In detail, a manual movement of the catch 4 from the open position into the preliminary latching position causes the cinching routine to be initiated by the lock control C. The expression "manual movement" means, that the movement of the catch 4 insofar has been caused without the support of the cinching drive 9. This manual movement of the catch 4 accordingly goes back on a closing movement of the motor vehicle door 3 from an open door position, which corresponds to the open position of the catch 4, into a preliminary door position, which corresponds to the preliminary latching position of the catch 4.

The lock control C monitors, if a manual movement of the catch 4 from the open position into the preliminary latching position has taken place and accordingly causes the cinching routine to be initiated. For this, the lock control C can be control-wise coupled to a catch sensor 11, which may be a simple micro switch or the like. Other possibilities for monitoring the catch movement are well applicable.

According to some embodiments, during the cinching routine, the catch 4 performs a first catch movement in its opening direction 12 from the preliminary latching position (FIG. 3*b*) into a safety position (FIG. 3*c*). Subsequently, during the cinching routine the catch 4 performs a second catch movement in its closing direction 13 from the safety position (FIG. 3*c*) into the main latching position (FIG. 4). This means that after the cinching routine has been initiated by the lock control C, the catch 4 performs the first catch movement in its opening direction 12 and subsequently performs a catch movement in its closing direction 13. As noted in the general part of the specification, with the proposed solution, any jamming of an object, in particular a finger of the user, may be dissolved easily, as the cinching routine starts with the first catch movement in its opening direction 12, which goes along with a certain opening movement of the respective motor vehicle door 3.

Figure 3:
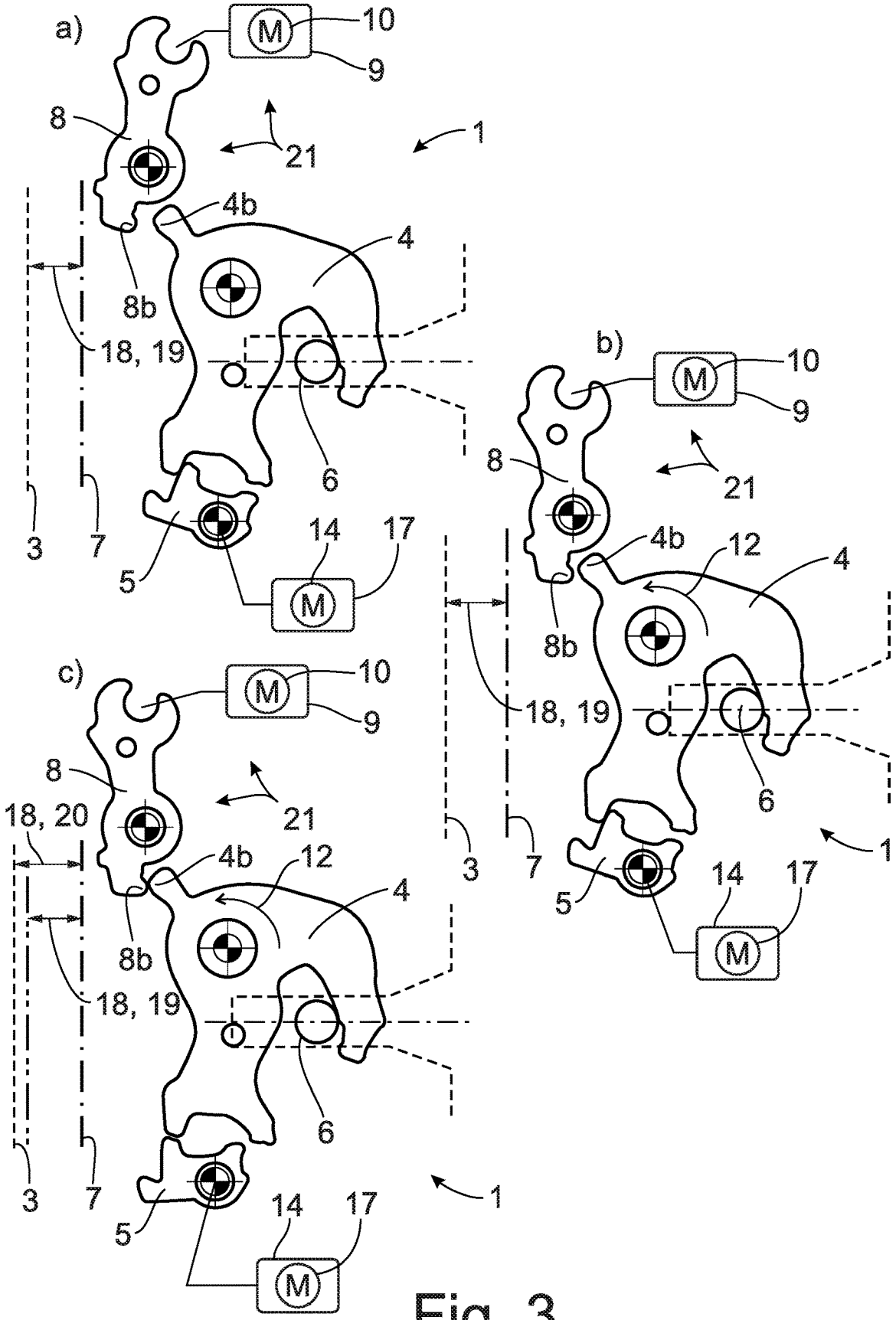
FIG. 3 shows the motor vehicle lock according to FIG. 2 a) in its preliminary latching position, b) in its preliminary latching position with the cinching element having been moved into its holding position and c) with the catch in its safety position
Figure 4:
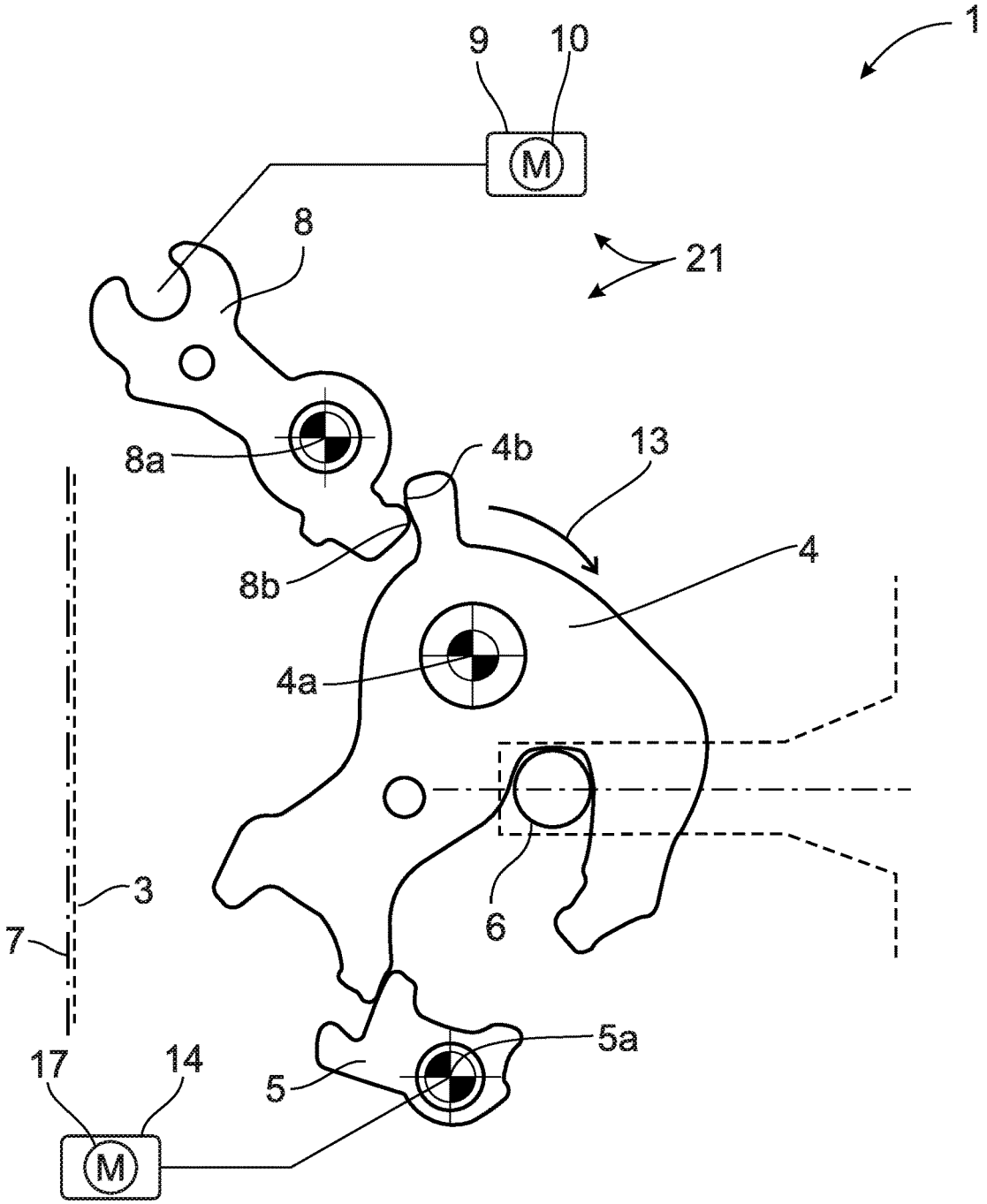
FIG. 4 shows the motor vehicle lock according to FIG. 2 with the catch in its main latching position.

In particular, during the cinching routine, the cinching element 8 is being driven into a holding position by the cinching drive 9, which situation is shown in FIG. 3*b*. This movement of the cinching element 8 is performed without the cinching element 8 coming into engagement with the catch 4. Simultaneously or at least almost simultaneously, alternatively after a certain delay time, the pawl 5 is being driven into its release position by an opening drive, which situation is shown in FIG. 3*c*. This deflection of the pawl 5 into its release position causes the catch 4, as the first catch movement, falling into its safety position, in which the catch 4 is being held by the cinching element 8. The catch 4 in its safety position is shown in FIG. 3.

FIG. 3 shows the interesting fact, that in the safety position the catch 4 is solely held by the cinching element 4 and not by the pawl 5. In this embodiment it has been found that the cinching element 8 may be used to realize another stable position of the catch 4 besides the preliminary latching position, the main latching position and the open position, in which the catch 4 is in engagement with the lock striker 6.

Here, the first catch movement is being driven by a catch spring 15 shown in FIG. 2 only and/or the sealing pressure of door seals 16 assigned to the motor vehicle door 3. Accordingly, no motor is needed for realizing the first catch movement as such. Only the initiation of the first catch movement goes back on the opening drive 14 as noted above.

The opening drive 14 can be a motorized drive as well. Here, the opening drive 14 comprises an opening motor 17, which further can be an electric, in particular rotational, motor. It has been indicated above, that one single motor may be provided as part of the cinching drive 9 on the on side and as part of the opening drive 14 on the other side.

After the first catch movement, as the second catch movement, the catch 4 is being driven into its main latching position by the cinching drive 9 via the cinching element 8. This is represented by the transition from FIG. 3*c* to FIG. 4.

It is to be understood that as long as the catch 4 is in engagement with the lock striker 6, each change in the position of the catch 4 corresponds to a change in the position of the respective motor vehicle door 3 over a wide range of catch positions. This means that depending on the position of the catch 4, the size of the gap 18 between the motor vehicle door 3 and the motor vehicle body 7 differs. In the drawings, this gap 18 is only indicated by the space between dotted lines, that represent the motor vehicle door 3 and the motor vehicle body 7.

Generally, in the mounted state of the motor vehicle lock 1, with the catch 4 being moved from the preliminary latching position into the safety position during the first catch movement, the gap 18 between the motor vehicle door and the motor vehicle body 7 increases from a preliminary gap 19 to a safety gap 20. In FIG. 3*c*, which represents the catch 4 being in its safety position, the preliminary gap 19 has been indicated as well. Here it becomes clear, that the safety gap 20 is larger than the preliminary gap by at least 25%, in particular by 25% up to 100%, with respect to the preliminary gap 19.

In absolute values, the size of the preliminary gap 19 is between 4 mm and 8 mm, such as 6 mm. The safety gap 20, on the other hand, can be between 6 mm and 12 mm, in particular 9 mm.

As noted above, the drive train 21, that is assigned to the cinching drive 9, is designed as a self-locking drive train. This means, that in the situation shown in FIG. 3*c*, it is not possible for the catch 4 to back drive the cinching drive 9 via the coupling between the engagement section 8*b* and the counter engagement section 4*b*. Accordingly, the holding of the catch 4 by the cinching element 8 is being performed by the drive train without activating the cinching drive 9. This makes the realization of the safety position of the catch 4 particularly easy.

According to another teaching, a motor vehicle lock arrangement comprising the motor vehicle lock 1 and the lock control C is disclosed. This teaching is particularly directed to the design of the lock control C, which is causal for performing the proposed cinching routine. Accordingly, all details given for the proposed method are fully applicable to this second teaching.

Some embodiments of the proposed motor vehicle lock arrangement is directed to the motor vehicle lock arrangement comprising an above noted opening drive 14, wherein during the cinching routine the cinching element 8 is being driven into a holding position by the cinching drive 9, while the pawl 5 is being driven into its released position by the opening drive 14, such that the catch 4, as the first catch movement, falls into its safety position and is being held there by the cinching element 8. Again, all details given above with regard to the proposed method are fully applicable.

According to another teaching, the motor vehicle door arrangement 2 with a motor vehicle door 3 and the above noted motor vehicle lock arrangement is disclosed. Again, all details regarding the proposed method and regarding the proposed motor vehicle lock arrangement are fully applicable.

Just as a matter of completeness it may be pointed out, that in the opening direction of the catch 4, the positions of the catch 4 are arranged in the order of main latching position, preliminary latching position, safety position and open position.

The invention claimed is:

1. A method for operating a motor vehicle lock of a motor vehicle door arrangement with a lock control, wherein the motor vehicle lock comprises a catch and a pawl, which is designed to interact with the catch, wherein the catch may be moved into an open position, into a preliminary latching position and into a main latching position, wherein the catch, which is in one of the latching positions, is or may be brought into holding engagement with a lock striker, wherein the pawl may be moved into an engagement position, in which the pawl is in blocking engagement with the catch, and wherein the pawl may be moved into a release position, in which the pawl releases the catch, wherein a cinching element and a cinching drive are provided and wherein, during a cinching routine, the catch is being moved into the main latching position of the catch by the cinching drive via the cinching element, wherein a manual movement of the catch into the preliminary latching position causes the cinching routine to be initiated by the lock control, and wherein during the cinching routine the catch performs a first catch movement in the opening direction of the catch from the preliminary latching position into a safety position and a second catch movement in the closing direction of the catch from the safety position into the main latching position.

2. The method according to claim 1, wherein during the cinching routine the cinching element is being driven into a holding position by the cinching drive and the pawl is being driven into the release position by an opening drive, such that the catch, as the first catch movement, falls into the safety position and is being held there by the cinching element.

3. The method according to claim 1, wherein the first catch movement is being driven by a catch spring and/or the sealing pressure of door seals designed to interact with the motor vehicle door.

4. The method according to claim 1, wherein after the first catch movement, and the second catch movement, the catch is being driven into the main latching position by the cinching drive via the cinching element.

5. The method according to claim 1, wherein, in a mounted state, with the catch being moved from the preliminary latching position into the safety position during the first catch movement, a gap between the motor vehicle door and a motor vehicle body increases from a preliminary gap to a safety gap.

6. The method according to claim 5, wherein the safety gap is larger than the preliminary gap by 25% up to 100%.

7. The method according to claim 5, wherein the size of the preliminary gap is between 4 mm and 8 mm.

8. The method according to claim 5, wherein a size of the safety gap is between 6 mm and 12 mm.

9. The method according to claim 1, wherein a drive train, that is designed to interact with the cinching drive, is designed as a self-locking drive train.

10. The method according to claim 9, wherein a holding of the catch by the cinching element is being performed by the drive train without activating the cinching drive.

* * * * *